US009818316B2

(12) United States Patent
Lasseel

(10) Patent No.: US 9,818,316 B2
(45) Date of Patent: Nov. 14, 2017

(54) MOVABLE INFORMATION DEVICE AND METHOD FOR THE MANUFACTURE THEREOF

(71) Applicant: CREA N.V., Roeselare (BE)

(72) Inventor: Sammy Lasseel, Smetlede (BE)

(73) Assignee: CREA N.V., Roeselare (BE)

( * ) Notice: Subject to any disclaimer, the term of this patent is extended or adjusted under 35 U.S.C. 154(b) by 0 days.

(21) Appl. No.: 14/436,702

(22) PCT Filed: Oct. 2, 2013

(86) PCT No.: PCT/EP2013/002957

§ 371 (c)(1),
(2) Date: Apr. 17, 2015

(87) PCT Pub. No.: WO2014/060067

PCT Pub. Date: Apr. 24, 2014

(65) Prior Publication Data

US 2015/0332610 A1 Nov. 19, 2015

(30) Foreign Application Priority Data

Oct. 18, 2012 (BE) ..... 2012/0707
Feb. 11, 2013 (BE) ..... 2013/0095

(51) Int. Cl.
*G09F 1/04* (2006.01)
*G09F 1/06* (2006.01)
(Continued)

(52) U.S. Cl.
CPC ..... *G09F 1/06* (2013.01); *G09F 1/10* (2013.01); *G09F 1/14* (2013.01); *G09F 7/12* (2013.01)

(58) Field of Classification Search
CPC ..... G09F 7/18; G09F 15/00; G09F 15/0012; G09F 15/0018
(Continued)

(56) References Cited

U.S. PATENT DOCUMENTS 1,821,025 A * 9/1931 Ohlson ..... G09F 1/04 248/174
3,422,556 A 1/1969 Lyons et al.
(Continued)

FOREIGN PATENT DOCUMENTS

CH 692229 A5 3/2002
GB 2349887 A 11/2000
(Continued)

OTHER PUBLICATIONS

Jay Shapiro, Why does water film increase friction between some surfaces?, Jan. 2011, MadSciNetwork: Physics, https://web.archive.org/web/20130103225415/http://www.madsci.org/posts/archives/2011-01/1295671125.Ph.r.html.*
(Continued)

*Primary Examiner* — Shin Kim
(74) *Attorney, Agent, or Firm* — Workman Nydegger

(57) ABSTRACT

A sliding information device for placement and sliding on an even and flat supporting surface wherein the device comprises a baseplate with a flat and even bottom surface and an upright element, fastened to its top surface by means of a base that enables elastic bending of the element back and forth from an unloaded rest position A to a loaded oblique position B and a method for manufacturing it comprising the cutting of a series of segments from an elastically bendable substrate.

20 Claims, 4 Drawing Sheets

(51) Int. Cl.
*G09F 1/10* (2006.01)
*G09F 1/14* (2006.01)
*G09F 7/12* (2006.01)

(58) Field of Classification Search
USPC ..... 40/606.01
See application file for complete search history.

(56) References Cited

U.S. PATENT DOCUMENTS 3,440,750 A 4/1969 Toth et al.
3,624,688 A * 11/1971 Miller ..... G03D 15/046 40/760
3,797,151 A * 3/1974 Dexter ..... B60Q 7/005 40/592
3,924,879 A * 12/1975 Wright ..... B42F 5/00 281/3.1
4,783,921 A * 11/1988 George ..... G09F 7/002 40/602
4,798,017 A * 1/1989 Giotis ..... G09F 7/002 116/63 P
4,917,342 A 4/1990 Fast
5,303,668 A * 4/1994 Huang ..... B60Q 7/00 116/63 P
6,136,392 A 10/2000 Sheffield, Jr. et al.
6,311,418 B1 * 11/2001 Crowell ..... G09F 1/08 283/117
6,513,270 B1 * 2/2003 MacKenzie ..... B42D 15/042 40/124.08
6,524,676 B1 * 2/2003 May ..... C09J 7/026 248/205.3
7,883,115 B2 * 2/2011 Keefe ..... B42D 13/00 281/15.1
8,044,942 B1 * 10/2011 Leonhard ..... G06F 1/1637 345/173
8,601,727 B2 * 12/2013 Feagins ..... G09F 1/06 40/124.16
2002/0122925 A1 * 9/2002 Liu ..... C08F 2/44 428/212
2003/0012936 A1 * 1/2003 Draheim ..... C08F 2/44 428/216
2003/0110613 A1 * 6/2003 Ross ..... G06F 1/1609 29/592
2007/0044354 A1 * 3/2007 Hiramoto ..... G09F 3/10 40/124.13
2012/0131825 A1 * 5/2012 Hoy ..... B42D 15/042 40/124.14
2014/0033583 A1 * 2/2014 Larson ..... B42D 15/022 40/124.03
2015/0116264 A1 * 4/2015 Ookawa ..... G06F 3/0412 345/174
2015/0235573 A1 * 8/2015 Quick ..... G09F 1/06 40/594

FOREIGN PATENT DOCUMENTS

GB 2429820 A 3/2007
WO 2002036360 A1 5/2002

OTHER PUBLICATIONS

International Search Report for corresponding International PCT Application No. PCT/EP2013/002957, dated Nov. 14, 2013.

* cited by examiner

MOVABLE INFORMATION DEVICE AND METHOD FOR THE MANUFACTURE THEREOF

The invention relates to a movable in particular a slideable information device with a ground support for placement on a supporting surface. The device also comprises an upright element that is connected to the ground support, which contains a baseplate, for example. This upright element then bears information, printed or otherwise, for example an advertisement, instructions or publicity message. The invention concerns also a very useful method for manufacturing such a device and assembling it from its elements, comprising ground support and upright element.

TECHNICAL FIELD, STATE OF THE ART

Such information devices are generally known. For the most part, the ground support is a movable stand of plastic, wood or metal, with an integrated upright holder in which or on which a medium, in plate or sheet form for example, for the intended informative message can be slid or stuck. This design makes the device considerably expensive. Sometimes the device can also be too easily knocked over such that the intended function as a medium for a message no longer attracts attention until the device is stood or put upright again.

It is known that a horizontal plate, for example a glass plate, with a flat, very even and smooth bottom surface can be slid over and adjustably attached by suction to a very even and flat top surface of a supporting horizontal (glass) plate. The perfect contact between the two plates prevents air being able to penetrate into the mutual contact zone close to the outside edge of this zone. A vacuum or sub-pressure is, as it were, created between the (glass) plates. The atmospheric pressure on the free outer surfaces of the two plates thus keeps them firmly pressed together. Due to their smooth contact surface, the plates can slide somewhat over one another without detaching from one another. In other words, the vacuum area slides with the contact surface. U.S. Pat. No. 3,422,556 relates to an information device with a magnetic base plate and an upright holder for carrying an information marker for use on automobiles or other magnetic objects.

On the other hand, a non-adjustable information medium in plate form according to an analogous vacuum adhesion principle is known from U.S. Pat. No. 6,136,392. This information medium comprises a partially convex outer surface and a partially concave inner surface, and a cavity between this inner surface and the supporting surface on which the medium must be attached. By pressing the flexible convex part of the medium centrally onto the supporting surface, the air there is driven out of this cavity past the outside edges of the contact surface with the supporting surface. In this way, a vacuum area is created in this contact surface. This vacuum area ensures that the information medium is firmly, but not adjustably, affixed to the supporting surface analogous to a suction pad effect. For the rest, this information medium has no upright element. GB 2429820 discloses a suction cup mounted sign for a vehicle.

The purpose of the invention is to provide a movable information device with a ground support and with an upright element whereby the device does not fall over when the upright element is collided with transversely. In other words, the ground support must not detach from its supporting surface upon such a collision. The invention further aims at keeping the device readily able to slide over the supporting surface for the purpose of its versatile usability. Thus the device must for example not be attached immovably or rigidly to the supporting surface. Moreover, according to a further objective, the device preferably does not completely detach from the underlying supporting surface when it is gripped at the top of its upright element and then it is attempted to slide it over the supporting surface, or if a person wants to wrench it away in a direction almost perpendicular to the supporting surface.

Due to its typical spatial structure with a ground support and an upright element, it is difficult to package and transport the information device in an easy and compact manner. This is a great disadvantage because generally a large number of devices have to be packaged and shipped together to the user. It is thus in addition a purpose of the invention to provide a manufacturing method that enables an easy packaging and transportation of the movable information devices. It is at the same time a purpose of that method to allow an easy manual, semi-automatic or automatic assembly of the movable information device from its components. In particular it is a purpose to provide a manufacturing method that enables the ground support and the upright element components to be manufactured together at the same time so that they can be assembled in view of a compact packaging.

BRIEF DESCRIPTION OF THE INVENTION

According to the invention, these objectives are met in a surprising way by a movable, in particular sliding, information device for placement and sliding on (over, in contact with) an even and flat supporting surface. As a ground support, the device consists of a baseplate with a flat and even surface on its underside. An upright element is fastened to the top surface of the baseplate via a base. According to the invention, it is important that the base allows elastic bending of the upright element back and forth from an unloaded rest position A to a transversely loaded oblique position B as explained hereinafter.

According to another important aspect of the invention, the base of this upright element comprises a limited fastening zone with the baseplate as explained hereinafter. This fastening zone runs substantially parallel to the upper surface of the baseplate. The distance "b" between the edge of this fastening zone of the base and the outside edge or peripheral edge of the baseplate must not be less than 2.5 cm anywhere according to the invention.

According to a further aspect of the invention, the upright element is preferably fastened almost in, or facing the centre of the baseplate. The upright element will also often be fastened almost perpendicular to the said top surface.

For the rest, the invention provides a series of other important preferred characteristics of the device as contained in the added claims and further explained hereinafter.

With regard to the favourable method of manufacturing the movable information device the objectives of providing an easy assembly from its components, enabling a compact packaging and transportation, the method comprises the application of printing on an elastically bendable substrate in plate form, and the cutting or stamping (punching) out of a series of segments from that substrate. The outer periphery of these segments defines the components bordering each other for the device such as the upright element, base, an extension piece of that base and the baseplate as is explained hereinbefore and hereafter.

According to an important characteristic of the method, the dividing line between that extension piece and the baseplate is preferably not entirely cut through during this cutting operation. A suitable fixing means is also applied onto the said base. Then the baseplate is folded over from the segment by 180° along the said dividing line, preferably the incompletely cut dividing line. The baseplate is thereby pressed against the base onto the applied fixing means for a strong and durable attachment there.

The upright element is now folded back from this flat laminated structure by 90° (perpendicularly) along the folding line between the base and the upright element. In this way, the intended spatial structure for the information device is set up, with its baseplate and its upright element durably bonded to it.

In practice, the flat segments cut out in series will often be immediately stacked on one another to be able to compactly ship them to the user, for example after the baseplate has been folded over from the segment by 180° and strongly attached to the base by adhesive.

After unstacking these thus obtained, laminated, primarily flat structures, the user can perpendicularly fold out the upright element for each information device to be set up. After setting up, the perpendicular position of the upright element can, if desired, be additionally locked by folding out at least one suitable prop element that can be folded out from the upright plate.

BRIEF DESCRIPTION OF THE DRAWINGS

A number of embodiments of the movable information device and aspects of a favourable method to manufacture them according to the invention will now be described on the basis of accompanying drawings. It goes without saying that the protection is not limited to these embodiments. They are only to be taken as examples for clarification of the scope of protection claimed in the claims.

DETAILED DESCRIPTION

Figure 1:
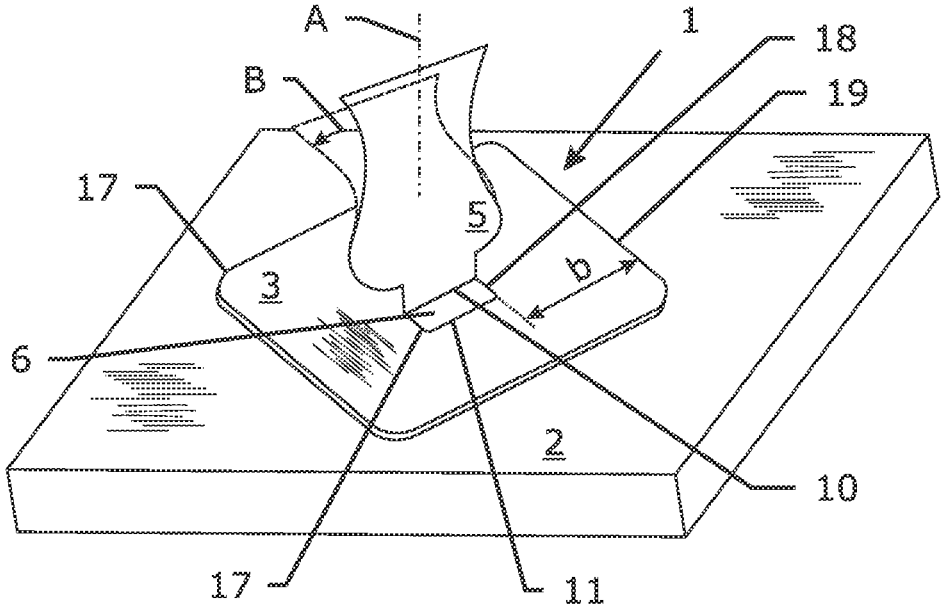
FIG. 1 is a perspective sketch of a movable information device on an even supporting surface according to the invention.

In the arrangement according to FIG. 1, the information device 1 with its baseplate 3 is set down on the even and flat, possibly smooth, horizontal top surface as a supporting surface 2. This even supporting surface can be a table top, for example, if necessary with a ground or polished surface of wood or veneer, plastic, glass, natural stone, marble, concrete or metal. A substrate with an even and smooth topcoat, for example a coat of lacquer, can also be used as a supporting surface 2. The baseplate 3 also has a pronounced even and flat, possibly smooth, underside (bottom) surface 4 that rests on the table top and whereby the underside surface 4 makes perfect contact with the supporting surface 2 without enclosing an air film. The contact zone thus behaves as a sub-pressure or vacuum area while the top surface of the baseplate 3 is exposed to atmospheric pressure. As a result, this baseplate with the device 1 can only slide over the supporting plate 2, and also without detaching from it.

Figure 2:
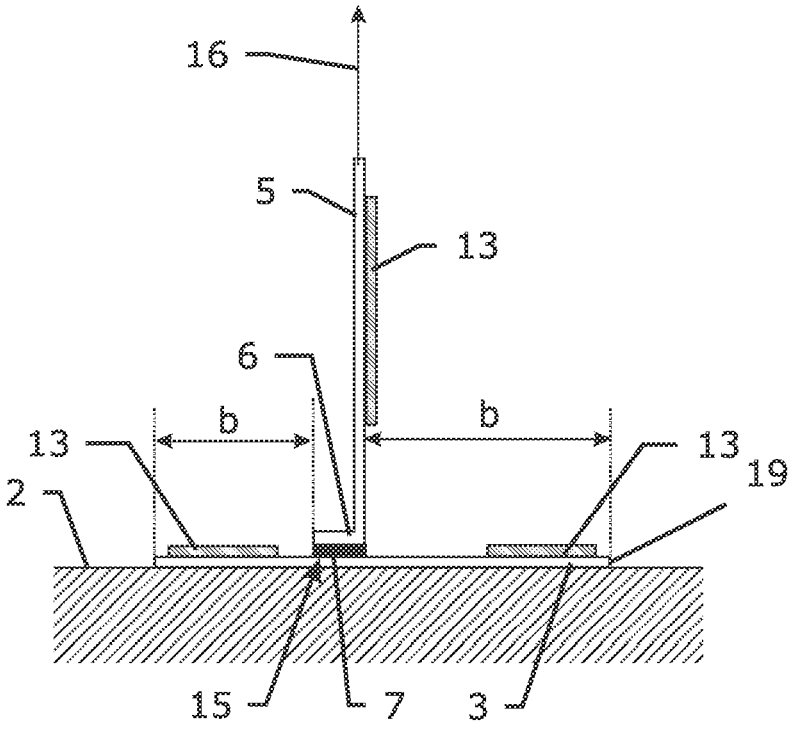
FIG. 2 schematically shows a cross-section of a detail of the fastening zone between the base and baseplate when the information device is in rest position A.

The upright element 5 in FIG. 1 and FIG. 2 is fastened in its vertical rest position A on the baseplate 3 by means of a base 6, for example by inserting a fastening zone 7 in the form of a strong adhesive for example (Loctite or a double-sided adhesive tape). The baseplate lays thus completely flat on the supporting surface 2. An information message 14 (FIG. 4) can be applied, for example printed, to one or both sides or walls of the upright element 5. The printing will then preferably be done before the baseplate and upright element are fastened together. Analogously information messages can be applied to the baseplate, at least on its topside. If desired, separate, possibly removable, extra information media 13 can be affixed on the baseplate 3 and/or on the upright element 5. These information media 13 may be three-dimensional objects. If desired, the upright element itself can have a three-dimensional form above its base.

The baseplate 3 is sufficiently rigid but can be somewhat flexible, for example a plastic. It will in general at least contain plastic in its even underside surface 4. A perfectly flat PVC sheet is preferable. Its thickness is between 0.2 mm and 0.8 mm, and preferably between 0.35 mm and 0.5 mm for the purpose of a suitable flexibility and pliability. The bottom surface 4 of the baseplate has a surface greater than 30 $cm^2$, and preferably greater than 40 $cm^2$, and can be up to 1 $m^2$ depending on the desired volume of the information device. The baseplate 3 can be square, circular, oval or polygonal. It can also have a more irregular periphery. The base 6 does not necessarily have to be fastened close to the centre of the baseplate 3; in particular this is not necessary for a baseplate with an irregular periphery. The baseplate 3 preferably has rounded corners 17.

The upright element 5 is preferably also a flexible, in particular elastically bendable, PVC plate with the same thickness as the baseplate 3. This simplifies the manufacture of the device 1, as the baseplate 3, base 6 and upright element 5, after applying the desired printing, can all be punched from the same PVC plate. The upright element 5 can also have a pronounced decorative form, as sketched in FIG. 1.

The base 6 can be rectangular, preferably also with rounded outside corners 17. It can also have the shape of a semicircle (half-moon), for example. A conventional, strip-shaped substrate covered with adhesive on either side can be used as a strong adhesive in the fastening zone 7.

FIG. 2 also sketches in dotted lines a position in which the device 1 is gripped close to the top edge of its upright element 5 and is lifted upwards with a force according to arrow 16. As a result, the flexible baseplate can be lifted up somewhat just below the fastening zone 7 such that a (temporary) minimal, enclosed space 15 can occur above the supporting surface 2. This space 15 possibly causes a somewhat stronger sub-pressure there and thus even greater resistance to the detachment of the baseplate 3 from the supporting surface, for example while horizontally sliding the device 1 over the supporting surface. In order to finally remove the information device 1 from its supporting surface 2, the device 1 can be slid across it by its baseplate until a part of its peripheral edge 19 is past a free edge of the supporting surface 2. In this way, the sub-pressure or vacuum is then neutralised or removed.

FIGS. 1 and 2 also illustrate the important characteristic of the invention regarding the distance "b" from the outside edge 19 of the baseplate 3 to the peripheral edge 18 of the fastening zone 7 with the base 6. According to the invention, this distance "b" must not be less than 2.5 cm anywhere, but preferably greater than 3 cm. The distance "b" can also be markedly larger than 3 cm so that the minimal space 15 can remain relatively small, even with devices 1 with a substantially large baseplate 3 (for example greater than 100 $cm^2$). The fastening zone 7 will preferably have an area of a least 1 $cm^2$. In each case the space 15 must not extend beyond the supporting surface 2 to a boundary where an outside edge 19 of the baseplate 3 is lifted up from the supporting surface. This would mean a leak for the vacuum whereby air could flow in via this outside edge of the contact surface between the baseplate 3 and the supporting surface 2 into the space 15. The baseplate 3 would then immediately detach from the supporting surface.

Figure 3A:
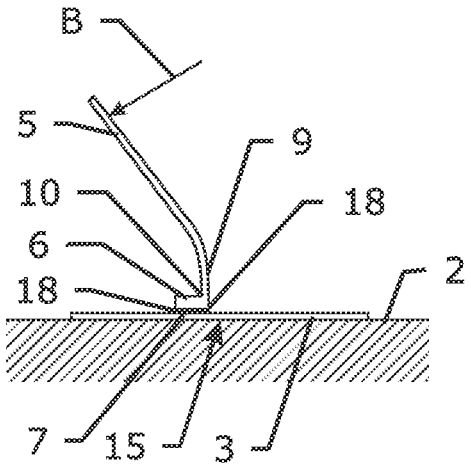
FIGS. 3*a* and 3*b* show a cross-section of a detail of the fastening zone between the base and the baseplate in the event of a transverse load on the upright element in an oblique position B.
Figure 3B:
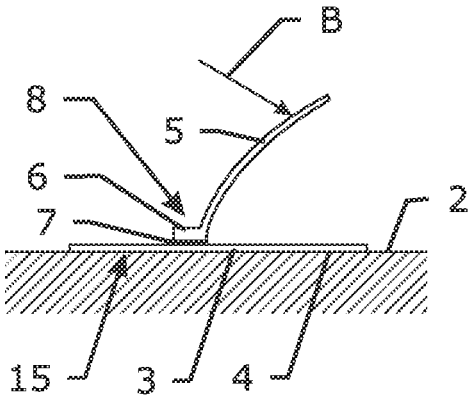

FIG. 3*a*, and FIG. 3*b* show two analogous positions in which the upright element 5 is pushed in an oblique position along a transverse direction B: once to the right and once to the left. The pressure in the direction B can be the result of a wind load on the device 1, for example. If the bending force B is now stopped in reaction, the flexible, elastically bendable upright element 5 will immediately elastically return to its rest position A, without the baseplate 3 having the opportunity to detach from the supporting surface 2.

A strong connecting zone 8, for example a substantially L-shaped profile, between the base 6 and upright element 5 supports and also fosters the realisation of the intended elastic bending for the element 5 when it is loaded in a transverse direction B and when this load is then removed. The strong connecting profile 8 can be realised, for example, with an upright element 5 of a thermoplastic by hot-folding its base 6 into a practically perpendicular plastic shape, for example via an intermediate zone 9 between the base 6 and upright element 5. This zone 9 can approximate the upright leg of an L profile, for example around its longitudinal axis 10 (as a folding line) in the intermediate (transitional) zone 9. This is also shown in FIG. 1. In FIG. 3*a* and in FIG. 4, the zone 9 comprises an advantageous division of the deformation over two parallel folding lines 10. This can foster a durable resistance of the intermediate zone to repeated bending loads. The folding lines 10 can be designed as a longitudinal groove or notch in the lower part of the upright element 5.

Figure 4:
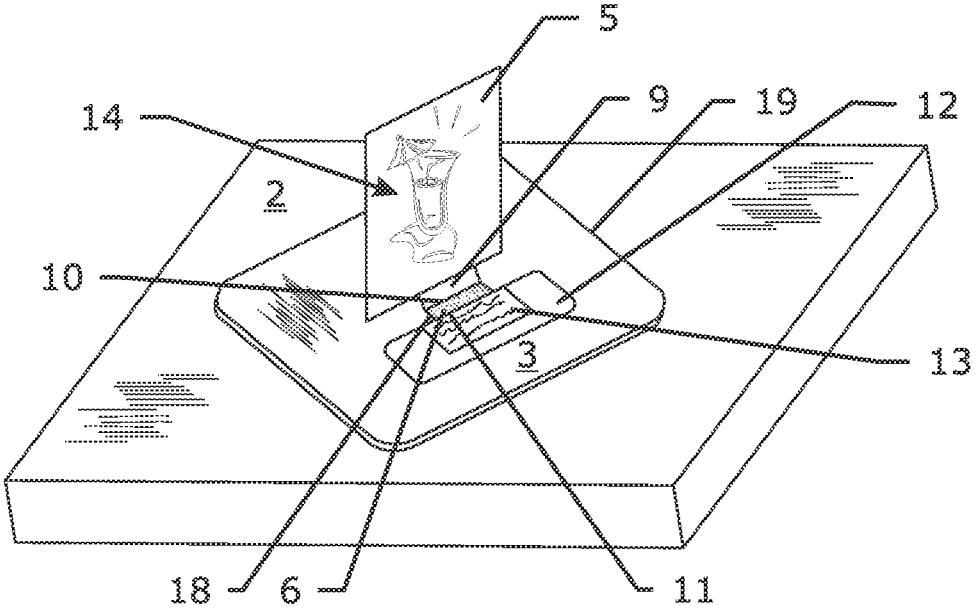
FIG. 4 sketches an embodiment with an extension piece that connects to the base.

The design according to FIG. 4 concerns the possible addition of an extension piece 12 to the base 6 close to its outside edge 11, and which, if need be, runs almost parallel to the baseplate 3. The extension piece always covers the baseplate 3 at least in part. In this way a split-shaped storage space is created between the baseplate and extension piece 12 for the insertion of one document or another, such as a receipt. The extension piece 12 can, if desired, protrude past the outside edge 19 of the baseplate. This does not impede the operation of the movable device 1.

Figure 5A:
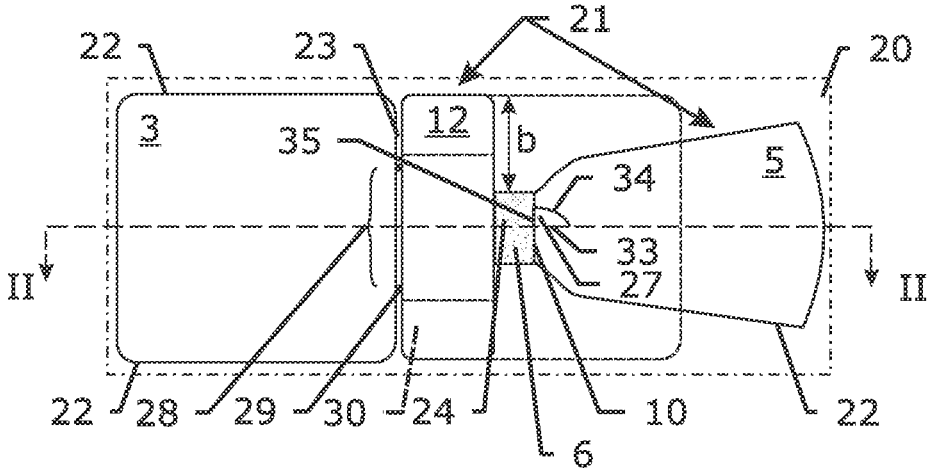
FIG. 5*a* shows a front view of a segment cut out from a substrate.

As sketched in FIG. 5*a*, the starting product for the manufacture of the information device 1 according to the invention is preferably an elastically bendable substrate 20 in plate form with an even and flat underside (bottom) surface 4. It can be a PVC or a polyethylene plate, for example. This substrate 20 is first provided with the desired printing 14 (FIG. 4) at the preselected places on one or both flat sides. Then the appropriate segments 21 are cut or punched out. The peripheral line 22 of these segments thereby defines the components of the device that border each other: the upright element 5, its base 6, an extension piece 12 against the base and finally the baseplate 3.

Figure 6:
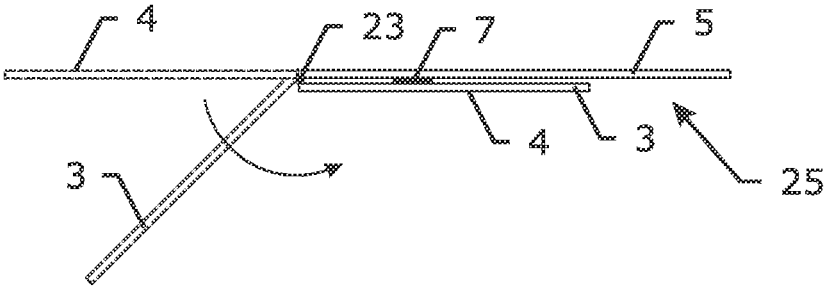
FIG. 6 shows a cross-section, according to line II-II of FIG. 5*a*, of a segment in a folded state for packaging.

The dividing line 23 between the baseplate 3 and the extension piece 12 can thereby be almost completely cut through. The length of the uncut section 28 in the dividing line 23 is then preferably short because this facilitates the subsequent folding over of the baseplate 3 by 180° along this dividing line 23. This short length of the section 28 can even be limited to one point zone 29, but preferably to two such point zones. The baseplate 3 and the extension piece 12 are then thus only connected at least at one, or preferably at least two, point zones 29. As a result, the precise folding over of the baseplate 3 by 180° along the dividing line, and keeping it in its correct position, can be readily done. Only after the end of the folding operation by 180°—and preferably after the strong bonding onto the base 6—will the point-shaped connecting zones 29 be readily broken up if desired. In this way, a laminated flat structure 25 is obtained, as shown in FIG. 6.

Figure 7:
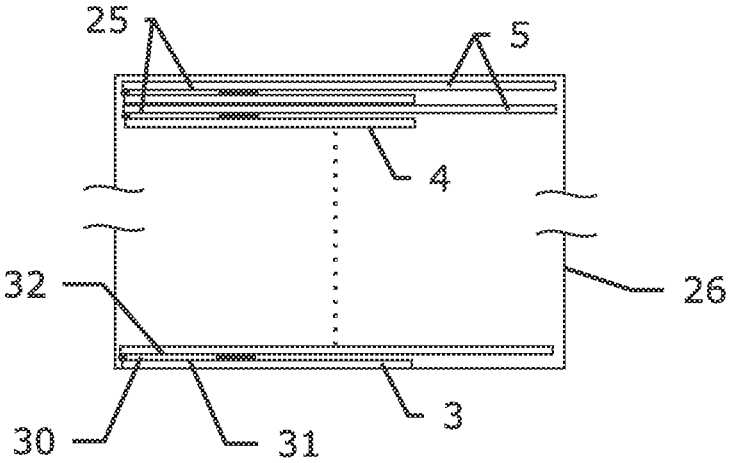
FIG. 7 sketches a stack of the folded segments according to FIG. 6 in their packaging.

As a result, a very advantageous effect also occurs for the flat structure 25 and for the device 1 in its folded open position. Indeed, a flat split 30 occurs between the top side 31 of the folded baseplate 3 and the outside edges of the extension piece 12 extending across it, as shown in FIG. 7. Temporary papers, such as business cards, napkin edges, order forms or bills can be clamped in these splits, if desired.

Figure 5B:
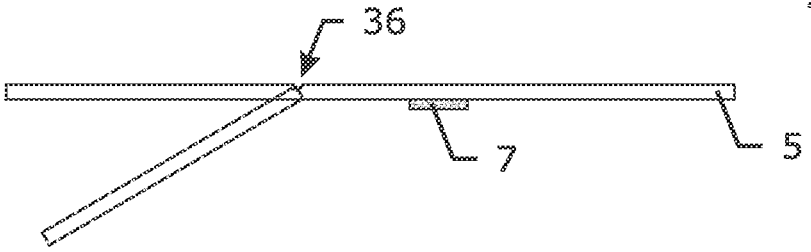
FIG. 5*b* shows a cross-section, according to line II-II of FIG. 5*a*.

In stead of a cut out dividing line 23, the embodiment of a segment 21 in FIG. 5*b* with a similar cross-section according to line II-II (in FIG. 5*a*) shows a groove or notch 36 at the place of that cut out dividing line 23. This groove will preferably extend along the dividing line 23 and along the entire width of the baseplate 3. Such groove 36 is to be considered according to the invention as a kind of a dividing line 23 that is not fully cut out. The presence of such groove 36 can foster an easy alternative bending and folding over of the baseplate 3 along the dividing line 23.

The cutting out of the series of segments 21 from the substrate 20, the successive application of the fixing means 24 to the bases 6, the folding over of the baseplate by 180° along the dividing line 23, and the strong bonding of the baseplate 3 to the bases 6 can be done by machine in a continuous operating line. Preferably a polyurethane or isocyanate glue is used as an adhesive part of the fixing means 24.

The strong and durable bond can be further assured by stacking a number of laminated structures 25 on one another (FIG. 7) and, if desired, the stack, packaged or otherwise, can be kept under transverse pressure for a certain time.

Figure 8:
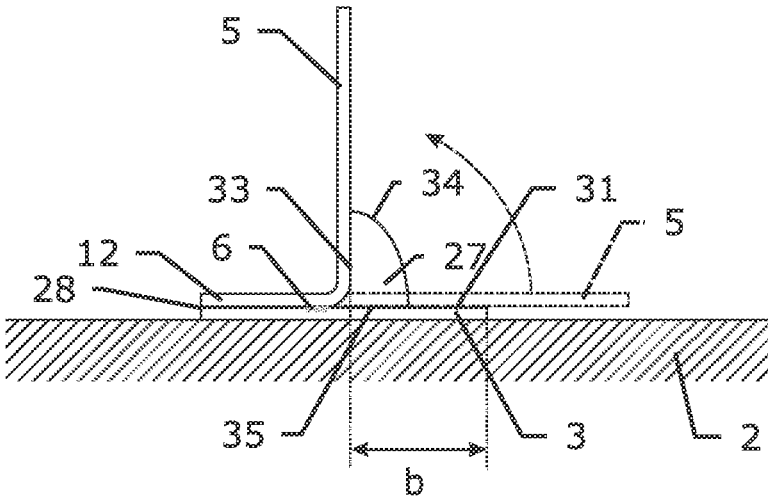
FIG. 8 illustrates a cross-section according tot line II-II of FIG. 5*a* after folding out the upright element by 90°.

The information device 1 in its folded open position according to FIG. 8 occurs by folding out the upright element 5, close to the folding line 10, by 90° from the laminated structure 25. In order to prevent this element 5 bending back from its straight upright position to a sloping position over time, a suitable prop element 27 can be folded out against the baseplate 3, for example along its folding line 33 in the upright element 5. Due to this measure, the upright position of the element 5 is locked. However, if the device is to be returned to its laminated flat structure 25 for more or less easy stacking, then the prop element 27 can be bent back along its folding line 33 in the plane of the element 5, and this element is then bent back against the baseplate 3. The prop element 27 shown in FIGS. 5*a* and 8 thus approximates a right-angled triangle, for example, the sloping side 34 and bottom edge 35 of which are made when punching out the segments 21.

The automatic bonding (in a continuous line) or semi-automatic bonding of the baseplate 3 onto the base 6, for the realisation of the laminated flat structure 25, can proceed as follows. The successive segments 21 can be punched from the substrate 20 with the partially cut dividing line 23 between the baseplate 3 and the extension piece 12 in a first stage in a transport line, for example comprising a continuous conveyor belt. At the same time, the cutting of the sloping side 34 and bottom edge 35 of the prop element 27 is done. In the next stage, the appropriate adhesives 24 are applied in the successive bonding zones (against the bases 6) passing by. Further on in the transport line, the successive baseplates 3 are suitably gripped mechanically and/or pneumatically and folded over by 180° along the dividing line 23 on the extension piece 12 and onto the bonding zones with adhesive 24. They are sufficiently pressed on them for initial bonding. With this folding over of the baseplate 3 from the substrate 20, the surrounding substrate residue around the parts 12, 6 and 25 keeps these parts in the right position for further operations and transit through the transport line. Just before or during the removal and stacking of the already (somewhat) laminated structures 25, the surrounding edge residues of the substrate 20 are then removed for recycling, for example. If desired, the stack can be suitably compressed under pressure for further consolidation of the adhesives for a durable and accurately positioned attachment of each base 6 on its accompanying baseplate 3.

Figure 9:
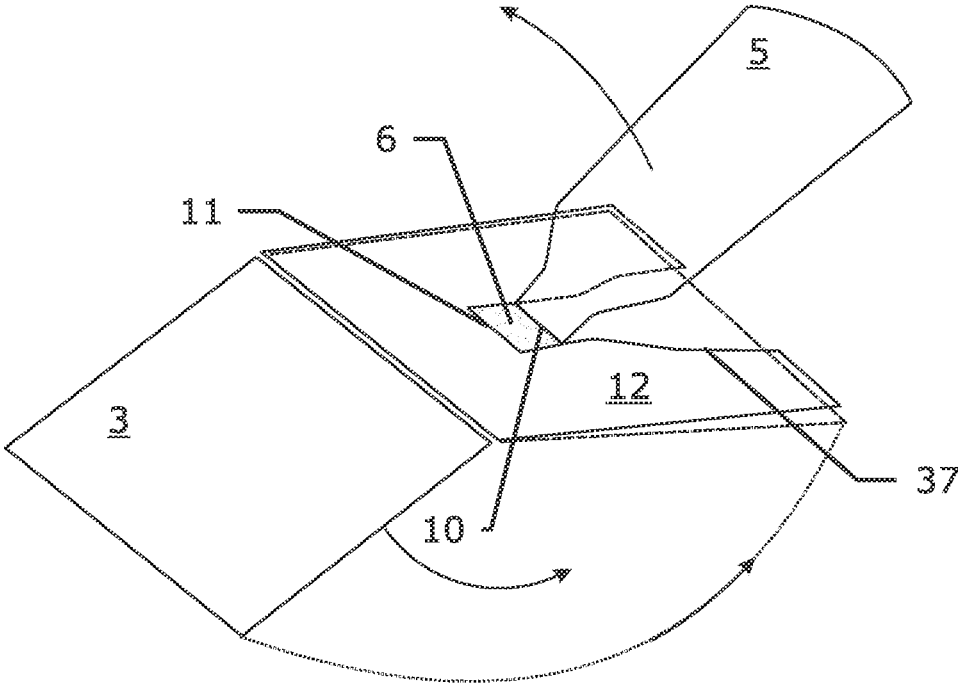
FIG. 9 is a perspective view of an embodiment of a movable device during a folding step of its components.

Finally, FIG. 9 illustrates an embodiment of the information device wherein the extension piece 12 is much larger than for example in FIG. 4 or FIG. 5*a*. Indeed the edges 37 can run parallel to the peripheral line 22 of the upright element 5 during punching out of the segments 21 from the substrate 20 (FIG. 5*a*). In this manner the extension piece 12 can cover a much larger part of the baseplate 3 and so contribute to an extra protection of this baseplate, combined even with a more complete use of the available plastic present in the original substrate 20.

At the same time, the flaps with edges 37 of the extension piece 12 offer extra space to insert in a removable way sheets, tags, cards in a larger split 30 than shown in FIG. 5*a*.

The invention is of course not limited to the described embodiments of the claimed information device and method. Many functional variants of the method stages and constructive variants of the information device, obvious to the person skilled in the art are conceivable.

The invention claimed is:

1. A sliding information device for placement and sliding on an even and flat supporting surface, wherein this device comprises a baseplate with a substantially planar and smooth bottom surface comprising plastic on its underside which is configured to form a vacuum between the bottom surface and the supporting surface, and an upright element fastened to its top surface by means of a base that enables elastic bending of the upright element back and forth from an unloaded rest position A to a transversely loaded oblique position B, and whereby the distance "b" between a peripheral edge of the baseplate and a peripheral edge of a fastening zone or area between the base and baseplate is not less than 2.5 cm anywhere.

2. The device according to claim 1 wherein the upright element is fastened substantially perpendicular to the top surface of the baseplate.

3. The device according to claim 1 wherein the upright element is fastened almost in the centre of the surface of the baseplate.

4. The device according to claim 1 wherein the baseplate and/or the upright element are printable on their walls.

5. The device according to claim 1 wherein there is a mutual connecting zone between the said upright element and base that enables the elastic bending.

6. The device according to claim 5 wherein this connecting zone comprises an intermediate zone realised by suitable plastic fold formation between the base and upright element.

7. The device according to claim 6 wherein the upright element is an elastically bendable plate around at least one longitudinal axis of a profile-shaped intermediate zone.

8. The device according to claim 1 wherein the base of the upright element and the baseplate are bonded together in the mutual fastening zone.

9. The device according to claim 1 wherein the base has an extension piece close to its edge opposite the connecting zone that runs parallel to the baseplate and that covers the baseplate at least in part.

10. The device according to claim 1 wherein one or more separate extra information media are affixed on the baseplate and/or the upright element.

11. The device according to claim 2 wherein the upright element is a PVC plate with the same thickness as the baseplate.

12. The device according to claim 1 wherein the upright element 5 comprises a prop element that can be folded out against the baseplate.

13. A method for manufacturing a movable information device according to claim 1 comprising the cutting of a series of segments from an elastically bendable substrate in plate form covered with printing, of which the outer periphery defines the components of the device bordering each other, such as the upright element, the base, the extension piece and the baseplate, and wherein the dividing line between the extension piece and the baseplate is not cut out over its entire length;

wherein fixing means are applied to the base; and wherein the baseplate is folded over from the segment by 180° along the dividing line and bonded against the base onto the fixing means; and wherein the upright element is folded back by 90° along the folding line between the base and the upright element.

14. The method according to claim 13 wherein after cutting out the segments they are stacked flat on one another and packaged, wherein the fixing means are applied after unstacking.

15. The method according to claim 13 wherein after cutting out, the fixing means is applied to the base on each of the segments and then the accompanying baseplate is folded over by 180° and bonded to the base, after which the thus obtained, laminated, primarily flat structures are stacked for bundling in packaging means.

16. The method according to claim 15, wherein, after unpacking, the upright element is folded back from the laminated structure by 90° into an upright position on the baseplate.

17. The method according to claim 13 wherein the length of the uncut section in the dividing line is limited to at least one and preferably two point zones.

18. The method according to claim 13 wherein after folding back the upright element by 90° along the folding line, a fold-out prop element is folded out from the upright plate to lock this plate into the upright position.

19. A cut-out segment, obtained as an intermediary product for the information device manufactured according to claim 13, comprising an upright element, a base, an extension piece and a baseplate with a dividing line, not cut out over its entire length, between this extension piece and this baseplate.

20. A laminated flat structure, obtained as an intermediary product for the information device manufactured according to the method of claim 15.

* * * * *